United States Patent [19]

Hirata

[11] Patent Number: 5,004,958

[45] Date of Patent: Apr. 2, 1991

[54] STROBE APPARATUS

[75] Inventor: Shinji Hirata, Toyonaka, Japan

[73] Assignee: West Electric Company, Ltd., Osaka, Japan

[21] Appl. No.: 388,378

[22] Filed: Aug. 2, 1989

[30] Foreign Application Priority Data

Aug. 3, 1988 [JP] Japan ..... 63-193784

[51] Int. Cl.[5] ..... H05B 41/14

[52] U.S. Cl. ..... 315/241 P; 315/240; 315/241 S

[58] Field of Search ..... 315/241 R, 241 S, 241 P, 315/232, 240, 200 R, 207, 188

[56] References Cited

U.S. PATENT DOCUMENTS 4,847,538 7/1989 Iwata et al. ..... 315/241 P

*Primary Examiner*—David Mis

*Attorney, Agent, or Firm*—Cushman, Darby & Cushman

[57] ABSTRACT

A series connection of a reverse direction diode 10 and a main capacitor 2 is connected across both terminals of a DC power source 1. Another series connection of a strobe tube 3 and forward semiconductor switching device 9 is connected across both terminals of the DC power source 1. A forward diode 11 is coupled between the series connections. Charging the main capacitor 2 is accomplished by a circuit form the DC power source 1, the main capacitor 2, the forward direciton diode 11 and the semiconductor switching device 9: whereas, discharging the strobe tube 3 is made through the strobe tube 3, the semiconductor device 9 and the reverse direction diode 10. The semiconductor switching device 9 is controlled both by a charge control circuit 14 and a light adjusting circuit 8.

7 Claims, 5 Drawing Sheets

T1
T2
T5

ON
OFF
T1
T2
T3
T4
T5

VM
T1
T2
T3
T4

T3

T4

T3
T4

STROBE APPARATUS

FIELD OF THE INVENTION AND RELATED ART STATEMENT

1. FIELD OF THE INVENTION

The present invention relates to a strobe apparatus, and particularly to a strobe apparatus of adjusted light amount.

2. DESCRIPTION OF THE RELATED ART

Various strobe apparatus have been proposed and are utilized practically, and a typical conventional circuit configuration of the strobe apparatus is shown in FIG. 4. In the conventional strobe apparatus of FIG. 4, a main capacitor 2 is connected across a DC power source 1, and across both ends of the main capacitor 2, a series connection of a strobe tube 3 and a thyristor 4 as a main switching device is connected. The strobe tube 3 and the thyristor 4 are triggered by a trigger circuit 5 which is operated by closing, for instance, a trigger switch Tsw.

A commutation capacitor 6, which is to be charged through charging resistors $R_1$, $R_2$, controls the operation of the thyristor 4 by discharging the charge stored therein through the thyristor 7 which is a sub-switching device. That is, the commutation capacitor 6 and the thyristor 7 and so on, known as the commutation circuit has been necessary.

The thyristor 7 is controlled of its operation timing by a light adjusting circuit 8 which, for instance, issues light stop signal at an instant when light amount of reflection light which is reflected from a photographic object lit by the flash light and received by a light sensor reaches a predetermined amount.

Now provided that, the trigger switch Tsw is closed in a state where the charging of the main capacitor 2 and the commutation capacitor 6 is completed by the operation of the DC power source 1, the trigger circuit 5 operates and the strobe tube 3 and the thyristor 4 are triggered. And thereby, the strobe tube 3 flashes by consuming the electric charge which has been charged in the main capacitor 2.

Subsequently, when the light stop signal is issued at operation of the light adjusting circuit 8, the thyristor 7 turns on, and the electric charge of the commutation capacitor 6 is discharged. Thereby, the thyristor 4 is turned to OFF-state, thereby to stop lighting of the flash tube 3. Incidentally, the operation of the trigger switch Tsw is controlled by operation of a camera which is not shown. Alternatively, the light stop signal sometimes is received from such a means outside the strobe apparatus.

Besides, the above-mentioned fundamental configurations, in actual conventional strobe apparatus, there have been various auxiliary configurations mentioned below, such as preventing glow discharge of the flash tube 3 or controlling the charging target value of the main capacitor 2 to the predetermined level.

That is, in case an accumulated cell having a high DC output voltage is used as the DC power source, there is a liability of generating glow discharge in the flash tube 3; for instance, a strobe apparatus is known wherein such a configuration is provided that energy feeding from the aforementioned power source 1 is stopped for a predetermined period after start of flashing.

Further, there is such a strobe apparatus capable of controlling the charged electric voltage value of the main capacitor 2 to a predetermined value for efficient utilization, etc. of the power source. For instance, such strobe apparatus is provided with a voltage detection circuit for detecting charged electric voltage of the main capacitor 2 and a control circuit which stops oscillation operation of a DC-DC converter for stopping feeding of energy to the main capacitor 2 by detection of output of the voltage detection circuit, in case the DC power source 1 contains a DC-DC converter circuit.

In the above-mentioned conventional strobe apparatus, the charging operation and discharging operation of the main capacitor 2 are carried out by control systems, each having a different configuration.

Control of the charging operation of the main capacitor 2 is generally carried out by operation of a power switch to control the oscillation in case of providing the DC-DC converter circuit.

Control of the discharging operation of the main capacitor 2 is carried out by operation of the thyristors 4, 7, the trigger circuit 5 and light adjusting circuit 8, namely by a means outside of the DC power source 1.

Configuring both the charging operation circuit and discharging operation circuit for the main capacitor 2 necessarily results in or increase cost to the strobe apparatus.

Furthermore, in the conventional strobe apparatus wherein the glow discharge prevention configuration and constant voltage control configuration in individual configurations also has been a factor of raising cost of the convention strobe apparatus.

OBJECT AND SUMMARY OF THE INVENTION

The object of the present invention is to provide a novel strobe apparatus with a smaller number of electric components than the conventional strobe apparatus.

In the strobe apparatus in accordance with the present invention, the above-mentioned object is realized by providing only one semiconductor switching device to control both charging and discharging of the main capacitor, only by controlling the potential of its control electrode.

In order to achieve the above-mentioned object, the strobe apparatus in accordance with the present invention comprising:

a DC power source, a first series connection of a strobe tube and a semiconductor switching device which is to be controlled by controlling potential of its control electrode only, said series connection being connected across both ends of said DC power source, a second series connection of a main capacitor and a first diode of reverse direction with regards to charging of said main capacitor, said second series connection being connected across said both ends of said DC power source, a second diode of forward direction with regard to charging of said main capacitor, connected across a first junction point between said main capacitor and said first diode and a second junction point between said strobe tube and said switching device, and an operation control circuit for controlling timings of turning-on and turning-off of said switching device and timing of excitation of said strobe tube, whereby to control charging and discharging of said main capacitor through turning-on and turning-off of said switching device.

While the novel features of the invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENTS

Figure 1:
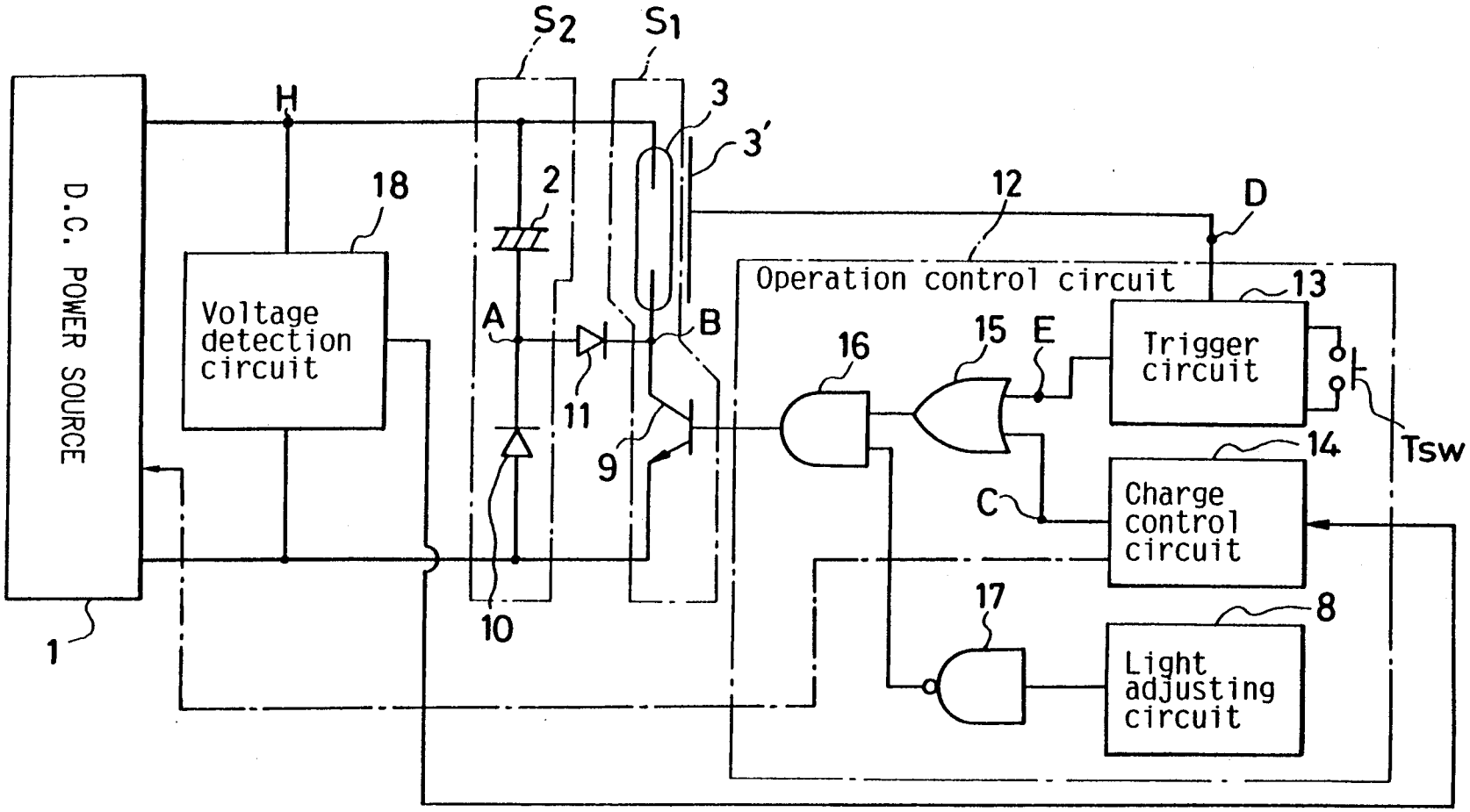
FIG. 1 is a circuit diagram of a strobe apparatus embodying the present invention.

FIG. 1 is a circuit diagram of a preferred embodiment of a strobe apparatus in accordance with the present invention. As shown in FIG. 1, across a DC power source 1, a series connection $S_1$ of a strobe tube 3 and a semiconductor switching device, such as transistor 9 which is to be controlled to be ON or OFF by controlling potential of its control electrode only, is connected. Across the same DC power source 1, another series connection $S_2$ of a main capacitor 2 and a reverse direction diode 10 is connected. Further across the DC power source 1 is connected a voltage detection circuit 18 which outputs a charge completion signal at completion of charging in the main capacitor 2. Further, between a junction point A, which is between the main capacitor 2 and the reverse direction diode 10, and the other junction point B, which is between the strobe tube 3 and the switching transistor 9, a forward direction diode 11 is connected, to allow a current flow from the main capacitor 2 to the switching transistor 9. With respect to switching device 9, other devices such as an IGBT (insulated gate bi-polar transistor) or a FET are usable, of course. The base, or a control electrode, of the switching device 9 is connected to the output terminal of an operation control circuit 12. The operation control circuit 12 comprises: a known trigger circuit 13 for issuing a trigger signal to excite and trigger the strobe tube 3 when a trigger switch Tsw closes; a charge control circuit 14 for issuing a charge control signal to be impressed on the base of the switching transistor 9 through an OR circuit 15, so as to control charging of the main capacitor 2 upon reception of voltage detection signal of the charge completion signal of the voltage detection circuit 18; a light adjusting circuit 8; a NAND circuit 17 connected to receive an output of the light adjusting circuit 8; and an AND circuit 16 which receives outputs of the OR circuit 15 and the NAND circuit 17 and issues an output to the base of the switching transistor 9.

The charge control circuit 14 controls its output by means of both manual operation and receiving of the voltage detection signal from the voltage detection circuit 18, to make automatic control of charging of the main capacitor 2.

Figures 2A, 2B, 2C, 2D, 2E, 2F, 2G:
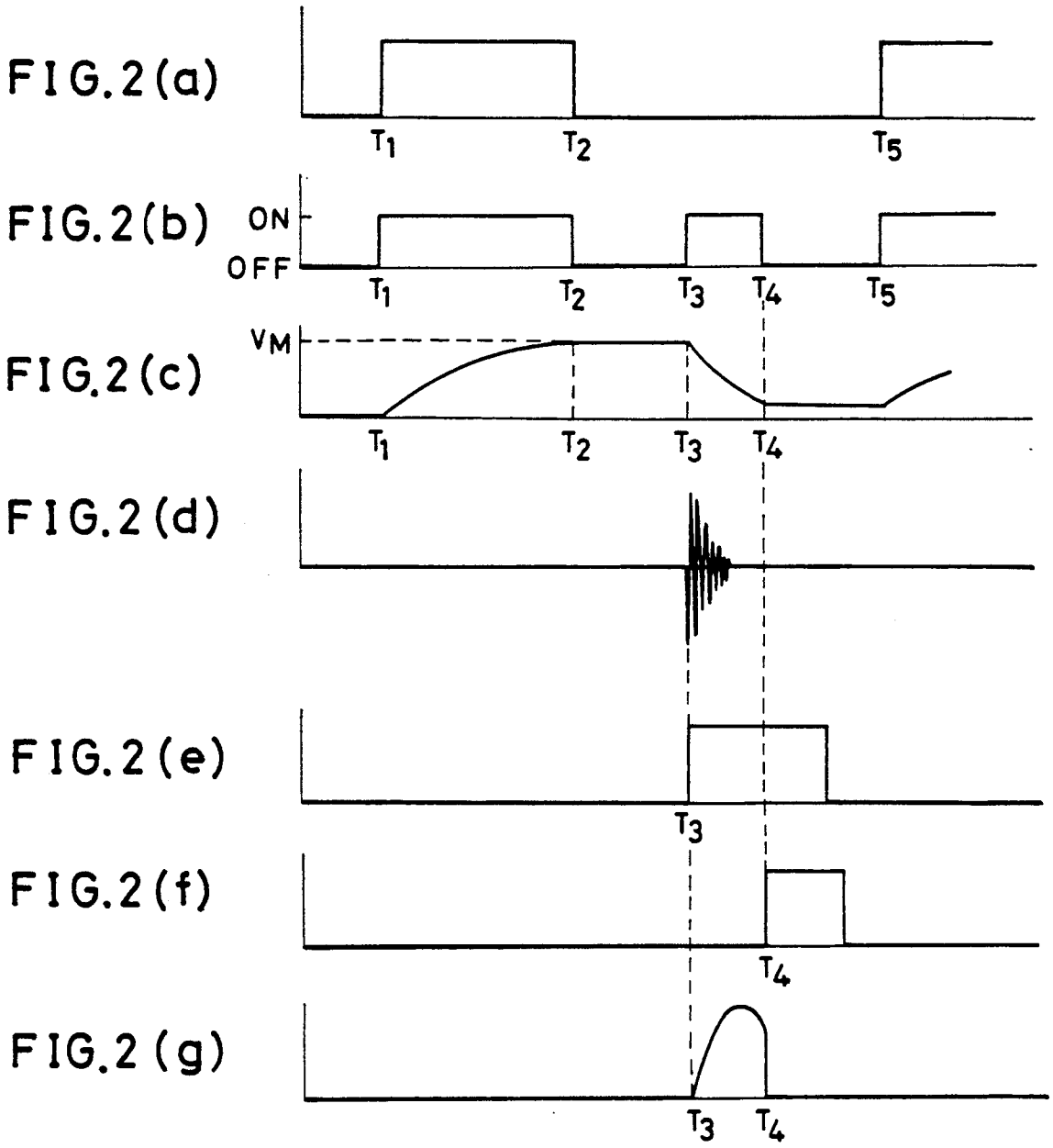
FIG. 2(*a*) through FIG. 2(*g*) show signal waveforms and light waveforms of various points in the circuit of FIG. 1.

Operation of the above-mentioned circuit of FIG. 1 is elucidated now with reference to FIG. 2, wherein FIG. 2(*a*) through FIG. 2(*g*) are waveforms of signals at various points in the circuit of FIG. 1 and waveform of light issued by the strobe tube.

In the circuit of FIG. 1, in a waiting state or steady state, the output signal of the operation control circuit 12 and the voltage detection circuit 18 are at low level, and therefore the switching transistor 9 is retained in OFF-state.

In the above-mentioned waiting or steady state, at time $T_1$, the charge control circuit 14 is operated manually or by reception of the charge completion and a high level signal as shown in FIG. 2(*a*) is issued at the point C (output side of the charge control circuit 14) of FIG. 1 to the OR circuit 15. The high level signal is given to the AND circuit 16 through the OR circuit 15, and the AND circuit 16 gives the high level signal to the base of the switching transistor 9. Therefore, the transistor 9 turns to ON-state from hitherto OFF-state shown in FIG. 2(*b*), and as a result, a charging current flows in a loop connecting the DC power source 1, main capacitor 2, the forward direction diode 11, the switching transistor 9 and the other end of the DC power source 1, and therefore charges the main capacitor 2 with a charging current as shown in FIG. 2(*c*).

When the voltage of the main capacitor 2 reaches to a predetermined voltage $V_M$ at time $T_2$, the voltage detection circuit 18 issues the charge completion signal to stop the operation of the charge control circuit 14 and to turn the output terminal (point C of FIG. 1) to low level as shown in FIG. 2(*a*). When the point C turns to the low level, the output terminal of the AND circuit 16 becomes low level and the switching transistor 9 is switched to OFF-state as shown in FIG. 2(*b*) at time $T_2$. At the same time, the charging of the main capacitor 2 is stopped and the charged voltage is controlled to the predetermined voltage $V_M$, thereby achieving a constant voltage.

When the trigger circuit 13 is operated at time $T_3$ when the charging of the main capacitor 2 is finished, a trigger voltage of FIG. 2(*d*) and a trigger signal of FIG. 2(*e*) are issued to the points D and E of FIG. 1, respectively. The above-mentioned trigger voltage is given to the trigger electrode 3' of the strobe tube 3, and the trigger signal is given through the OR circuit 15 to the AND circuit 16. Therefore, the strobe tube 3 is excited and the AND circuit 16 again issues a high level signal to its output terminal, thereby turning on the switching transistor 9 as shown in FIG. 2(*b*).

Therefore, the charge in the main capacitor 2 is discharged in a loop connecting the strobe tube 3, the switching transistor 9, the reverse direction diode 10, and to the other end of the main capacitor 2. Discharging the main capacitor 2 causes the strobe tube 3 to radiate a flash light, as shown in FIG. 2(*g*).

During the flashing of light from the strobe tube 3, at time $T_4$, a light stop signal shown in FIG. 2(*f*) is issued from the light adjusting circuit 8 to the NAND circuit 17, and then the NAND circuit 17 issues low level signal to the AND circuit 16. Therefore, the output of the AND circuit 16 becomes low level at the time $T_4$, and thereby turning the transistor 9 off. When the transistor 9 becomes off, the aforementioned discharging loop of the main capacitor 2 is broken, and the light emission of the strobe tube 3 is stopped at time $T_4$ as shown in FIG. 2(*g*).

Thereafter, when another light emission is required, it is made by turning the transistor 9 ON at the time $T_5$ by operation of the charge control circuit 14 to charge the main capacitor 2 and thereafter actuating the trigger circuit 13.

In the embodiment in accordance with the present invention, the single switching device, namely the transistor 9, has the below-mentioned plural functions:

First, the switching device 9 is turned on by means of operation of the charge control circuit 14, to complete the charge on charging loop of the main capacitor 2.

Second, by means of the operation of the charge control circuit 14 induced by the operation of the voltage detection circuit 18, the aforementioned charging loop is disconnected when the charged voltage in the main capacitor 2 reaches a preset value, thereby achieving a constant voltage charge on the main capacitor 2.

Third, by subsequent turning ON of the switching device 9 by means of operation of the trigger circuit 13 and exciting the strobe tube 3 to trigger by the trigger circuit 13, the switching device 9 completes a discharging loop of the main capacitor 2.

Fourth, by means of operation of the light adjusting circuit 8, the switching device 9 is turned off, thereby stopping the light emission at a desired point of time to adjust amount of light emission.

That is, as above-mentioned, the single switching device 9 carries out several operations necessary for strobe apparatus, which have been hitherto carried out by plural different switching devices. Furthermore, even when the discharge loop is cut off there is no fear of generating glow discharge because the switching device, namely the transistor 9, is in OFF-state hence disconnecting the strobe tube 3 from the DC power source 1.

In a modified embodiment, the DC power source 1 may be configurated such that, as is indicated by a chain line in FIG. 1, its generation of the DC voltage is controlled by the charge control circuit 14 so that the DC power source 1 starts its generation of the DC voltage only when charging of the main capacitor 2 becomes necessary and that its generation of the DC voltage is stopped when the charged voltage of the main capacitor 2 reaches a predetermined voltage.

Figure 3:
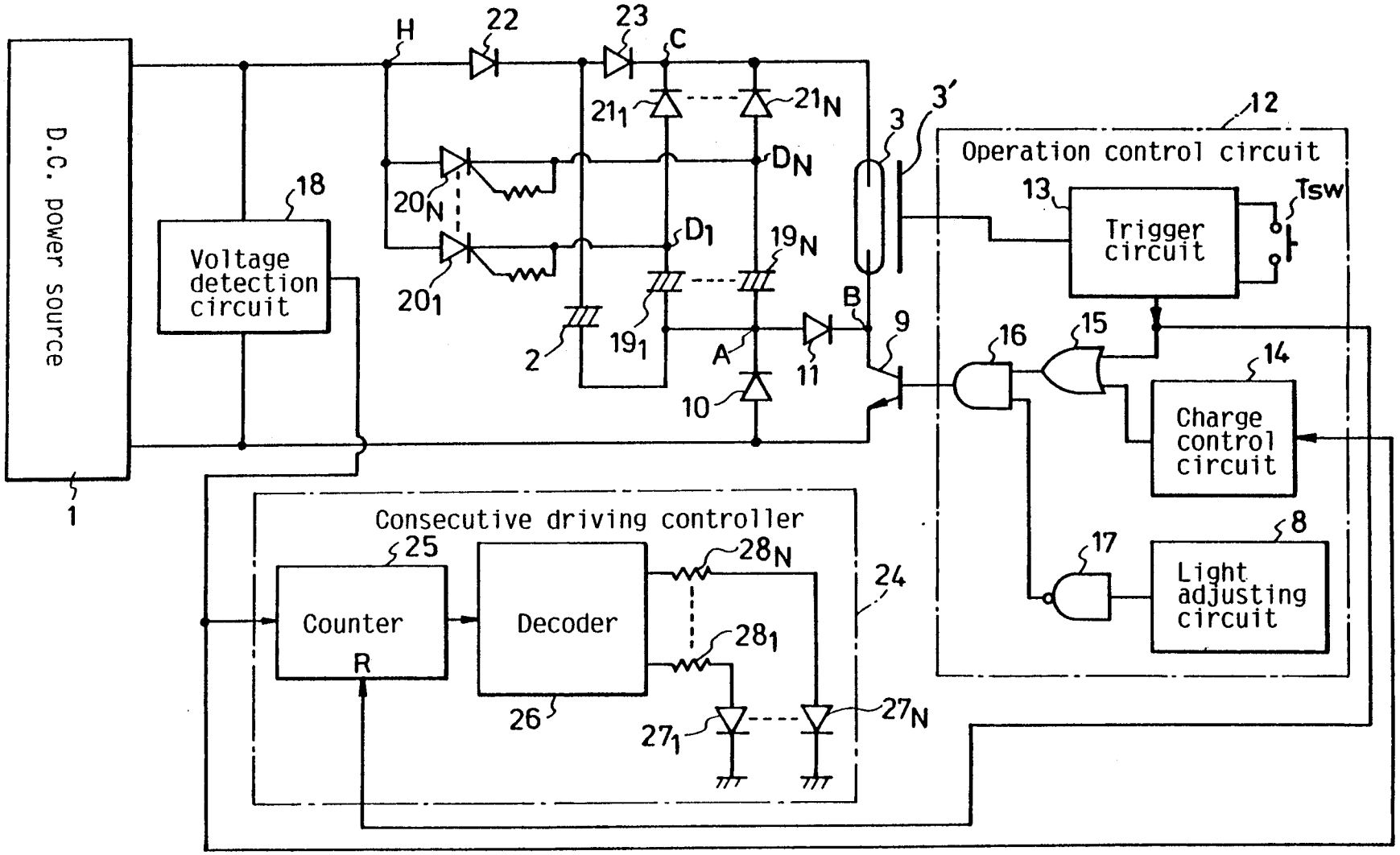
FIG. 3 is a circuit diagram of a strobe apparatus of another embodiment.
Figure 4:
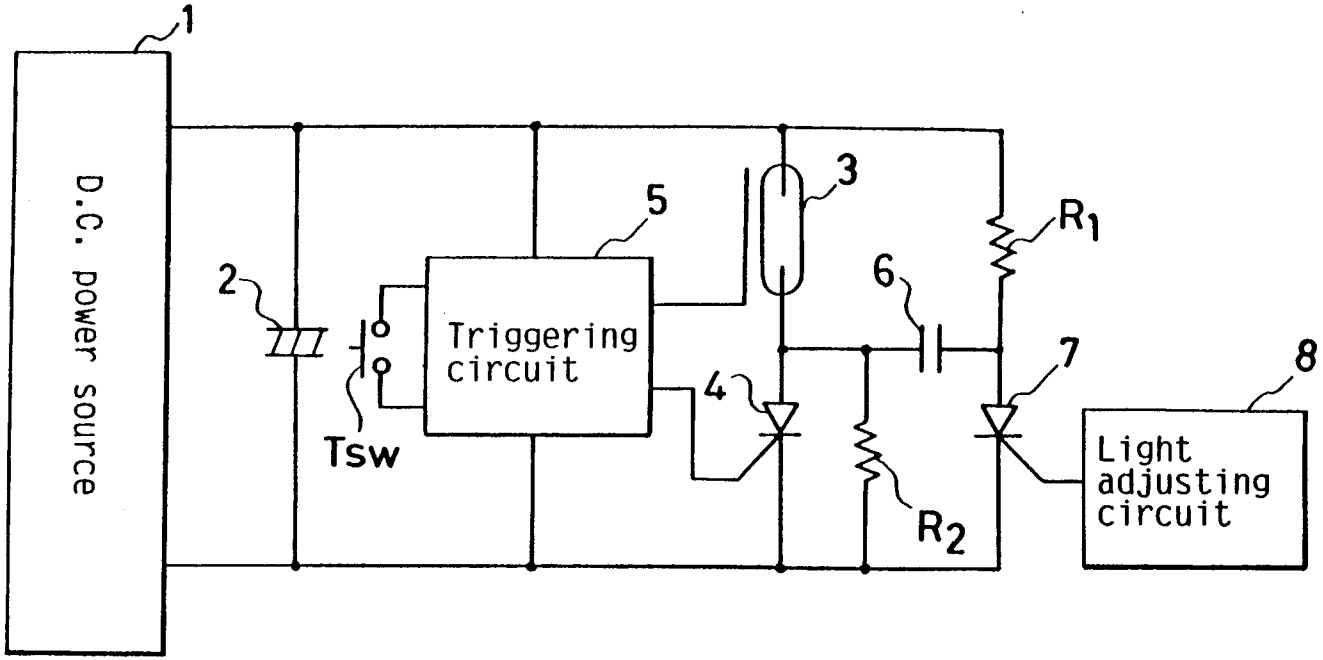
FIG. 4 is the circuit diagram of the typical conventional strobe apparatus.
Figure 4:
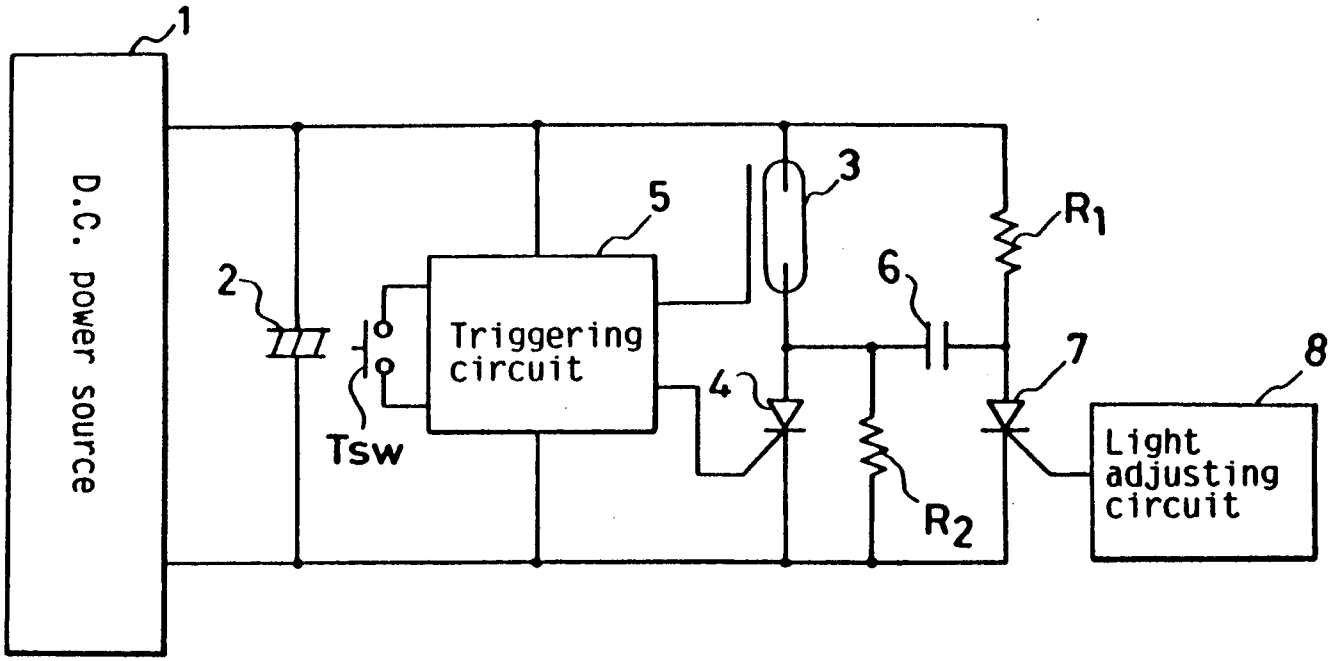
FIG. 4 (PRIOR ART)

FIG. 3 shows another embodiment of the present invention having plural auxiliary capacitors to suit a high speed repeated flashing.

As shown in FIG. 3, across a DC power source 1, a series connection $S_1$ of a strobe tube 3 and a switching device, such as transistor 9, is connected, Across the same DC power source 1, another series connection $S_2$ of second forward diode 22, a main capacitor 2 and a reverse direction diode 10 is connected. Further across the DC power source 1 is connected a voltage detection circuit 18 which outputs a charge completion signal at completion of charging in the main capacitor 2. Further, across the junction point A, which is between the main capacitor 2 and the reverse direction diode 10, and the other junction point B, which is between the strobe tube 3 and the switching transistor 9, a forward direction diode 11 is connected to allow a current flow from the main capacitor 2 to the switching transistor 9. As to the switching device 9, other devices, such as an IGBT (insulated gate bi-polar transistor) or a FET are usable, of course. The base or a control electrode of the switching device 9 is connected to the output terminal of an operation control circuit 12. The operation control circuit 12 comprises: a known trigger circuit 13 for issuing trigger signal to excite and trigger the strobe tube 3 when a trigger switch Tsw closes; a charge control circuit 14 for issuing a charge control signal to be impressed on the base of the switching transistor 9 through an OR circuit 15, so as to control charging of the main capacitor 2 upon reception of a voltage detection signal of the charge completion signal of the voltage detection circuit 18; a light adjusting circuit 8; a NAND circuit 17 connected to receive output of the light adjusting circuit 8; and an AND circuit 16 which receives outputs of the OR circuit 15 and the NAND circuit 17 and issues an output to the base of the switching transistor 9.

The charge control circuit 14 controls its output by means of both manual operation and receiving of the voltage detection signal from the voltage detection circuit 18, to control automatically the charging of the main capacitor 2.

The strobe apparatus of this second embodiment is advantageous by providing plural auxiliary capacitors $19_1, 19_2, \ldots 19_N$ when a high speed repeated flash lights is required. The above-mentioned plural auxiliary capacitors $19_1, \ldots 19_N$ are connected by their one ends through diodes $21_1, 21_2, \ldots 21_N$ to one end of a strobe tube 3, respectively. The other ends of the auxiliary capacitors $19_1, \ldots 19_N$ are connected to the junctions point A between the main capacitor 2 and the reverse direction diode 10. The aforementioned one ends of the auxiliary capacitors $19_1, 19_2 \ldots 19_N$ are further connected through thyristors $20_1, \ldots 20_N$ to the high potential end of the DC power source 1, respectively.

The second forward direction diode 22 is connected between the high potential side of the DC power source 1 and the high potential side of the main capacitor 2, and a third forward direction diode 23 is connected between the high potential side of the main capacitor 2 and the junction point C among the plural diodes $21_1, 21_2, \ldots 21_N$ and the high potential side of the strobe tube 3. These two forward direction diodes 22 and 23 isolate the auxiliary capacitors $19_1, 19_2 \ldots 19_N$ from the main capacitor 2 so that the charge of the auxiliary capacitors $19_1, \ldots 19_N$ does not flow back to the main capacitor 2. A consecutive driving controller 24 is provided in this circuit, wherein LEDs $27_1, 27_2, \ldots 27_N$ which are connected through respective resistors $28_1, 28_2, \ldots 28_N$ to output terminals of a decoder 28 to optically couple photo-thyristors $20_1, 20_2, \ldots 20_N$, respectively, and in each optically isolated relation. Therefore, the LEDs $27_1, \ldots 27_N$ and the photo-thyristors $20_1, \ldots 20_N$ form known photo-couplers, respectively. The photo-thyristors $20_1, 20_2 \ldots 20_N$ are connected between the high potential side H of the DC power source 1 and the respective high potential sides of the auxiliary capacitors $19_1, 19_2 \ldots 19_N$. Also provided in the consecutive driving controller 24 is a counter 25 receiving an output signal of the voltage detection circuit 18 and providing an output signal to the decoder 26.

The consecutive driving controller 24 receives voltage detection signals from the voltage detection circuit 18 and consecutively issues output signals to the LEDs $27_1, \ldots 27_N$, thereby consecutively to turning on the photo-thyristors $20_1, \ldots 20_N$. The counter 25 is reset by a signal from the trigger circuit 13.

The operation of the second embodiment shown in FIG. 3 is as follows.

The charging and discharging of the main capacitor 2 is carried out by the operation of the transistor 9 similarly to the circuit of FIG. 1 of the first embodiment. That is, when the charge control circuit 14 issues an output, the switching transistor 9 is turned on thereby allowing a current flow in a charging loop from the DC power source 1, through the second forward direction diode 22, the main capacitor 2, the first forward direction diode 11 and the transistor 9, to charge the main capacitor 2.

When the charging of voltage charge on the main capacitor 2 reaches a predetermined level, the voltage detection circuit 18 operates to issue a voltage detection signal which is a charge completion signal to the counter 25 and to the charge control circuit 14. Therefore, the charge control circuit 14 stops its output and the switching transistor 9 is turned OFF: and at the same time, the counter 25 issues a signal to make the decoder operate to issue a lighting signal for the LED $27_1$. By the lighting of the LED $27_1$, the photo-thyristor $20_1$, which is coupled to the LED $27_1$, is turned on thereby to connect the hitherto-uncharged auxiliary capacitor $19_1$ to the DC power source 1 to complete a charging loop from the DC power source 1 through the photo-thyristor $20_1$, the auxiliary capacitor $19_1$, the diode 11 and the transistor 9. By turning on the photo-thyristor $20_1$, the potential at the junction point H, which is between the high potential side of the DC power source 1 and the forward diode 22, rapidly falls and thereby the voltage detection circuit 18 interrupts its charge completion signal. Therefore, the charge control circuit 14 issues an output to restore the switching transistor 9 to an ON-state. As a result, a charging loop is completed connecting the DC power source 1, photo-thyristor $20_1$, auxiliary capacitor $19_1$, the first forward diode 11 and the switching transistor 9, to charge the auxiliary capacitor $19_1$.

As the auxiliary capacitor $19_1$ charges and the voltage thereof reaches a predetermined level, the potential at the junction point H again rises to a predetermined level and the voltage detection circuit 18 operates, thereby causing the charge control circuit 14 to issue a signal to turn the switching transistor 9 OFF. At the same time, by the operation of the consecutive driving controller 24, the second LED $27_2$ is lit; and thereby the second photo-thyristor $20_2$ is turned on; and thereby the not-yet-charged second auxiliary capacitor $19_2$ is connected through the turned-on thyristor $20_2$ to the DC power source 1. The potential of the junction point H again falls, causing the voltage detection circuit 18 to stop issuance of its output to the charge control circuit 14. Thereby, the transistor 9 turns on which causes the second auxiliary capacitor $19_2$ to be charged.

Thereafter, the similar operation is repeated to consecutively charge all the auxiliary capacitors up to auxiliary capacitor $19_N$.

Each of the once turned-on photo-thyristor is thereafter turned off by entering a reverse bias state at fall of the potential of the junction point H by the turning on of the next photo-thyristor, or by the cut-off action of the charging loop due to turning OFF of the switching transistor by operation of the voltage detection circuit 18.

After the main capacitor 2 and auxiliary capacitors $19_1$, $19_2$, . . . and $19_N$ are charged, when the trigger circuit 13 is operated by manual operation or automatic linkage operation with camera of the trigger switch Tsw, the strobe tube 3 is excited similarly to the aforementioned example 1, and at the same time the switching transistor 9 is turned on. Therefore, the discharge loop is formed connecting from the capacitors 2 through diode 23, or consecutively from respective auxiliary capacitors $19_1$, . . . or $19_N$ through respective reverse direction diodes $21_1$, . . . or $21_N$ to the strobe tube 3, and further through the switching transistor 9 and to the reverse direction diode 10, and flash the strobe tube 3.

At the same time, the trigger circuit 13 issues a reset signal and resets the counter 25 to prepare for the next charging operation.

When a light stop signal is issued from the light adjusting circuit 8 during the lighting of the strobe tube 3, the transistor 9 is turned off as already described with reference to the foregoing first example.

Similarly to the aforementioned first embodiment, according to the embodiment of the present invention, a single switching device, e.g. the switching transistor 9 can perform plural functions, and thereby a simplified circuit configuration is produced even in case of a strobe flash having plural auxiliary capacitors.

That is, since the charging loop and discharging loop of the main capacitor 2 and the auxiliary capacitors $19_1$, . . . $19_N$ can be configured by using a single switching device 9, there is no need to use a particular switching-off circuit for turning off respective photo-thyristors.

Furthermore, even when the discharge loop is cut off there is no fear of generating glow discharge, because the switching device, namely the transistor 9, is in an OFF-state, hence disconnecting the strobe tube 3 from the DC power source 1.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A strobe apparatus comprising:

a DC power source;

a first series connection of a strobe tube and a semiconductor switching device, said semiconductor switching device having a control electrode and being controlled by a controlling potential on the control electrode only, said first series connection being connected across said DC power source;

a second series connection of a main capacitor and a first diode of reverse direction with regards to charging of said main capacitor, said second series connection being connected across said DC power source;

a second diode of forward direction with regard to charging of said main capacitor, connected between a first junction point between said main capacitor and said first diode and a second junction point between said strobe tube and said switching device; and an operation control circuit for controlling timings to turn on and off said switching device and a timing to excite said strobe tube, whereby said main capacitor is charged and discharged by turning on and off said switching device.

2. A strobe apparatus in accordance with claim 1 wherein said operation control circuit comprises:

a trigger circuit for issuing a trigger voltage to said strobe tube to excite said strobe tube and a trigger signal to cause a turning on of said semiconductor switching device;

a charge control circuit for issuing a charge control signal to control said semiconductor switching device to set a charging time period for said main capacitor;

a light adjusting circuit for issuing a light stop signal to adjust a light amount emitted from said strobe tube; and a logic circuit means for turning on said semiconductor switching device at reception of said charge control signal or said trigger signal and turning off said semiconductor switching device at reception of said light stop signal.

3. A strobe apparatus in accordance with claim 2 which further comprises:

a voltage detection circuit, connected in parallel with said first series connection and said second series connection, for detecting charged voltage of said main capacitor and issuing a charge completion signal to said charge control circuit when said charged voltage reaches a predetermined value, whereby said charge control circuit outputs the charge control signal to turn off said semiconductor switching device and stop charging said main capacitor.

4. A strobe apparatus comprising:

a DC power source;

a first series connection of a first forward direction diode, a second forward direction diode, a strobe tube and a semiconductor switching device, said semiconductor switching device having a control electrode and being controlled by a controlling potential of the control electrode only, said first series connection being connected across said DC power source;

a second series connection of a main capacitor and a first reverse direction diode connected across said DC power source through said first forward direction diode;

third forward direction diode connected between a first junction point between said main capacitor and said first reverse direction diode and a second junction point between said strobe tube and said switching device;

a plurality of third series connections, each of which is a series connection of a semiconductor switch and an auxiliary capacitor and connected across a third junction point between said DC power source and said first forward direction diode and said first junction point;

a plurality of second reverse direction diodes which are connected across respective junction points between said semiconductor switches and said auxiliary capacitors and a junction point between said second forward direction diodes and said strobe tube;

an operation control circuit for (1) controlling timings to turn on and off said switching device and a timing to excite said strobe tube, whereby said strobe tube, whereby said main capacitor is charged and discharged by turning on and off said switching device, and (2) issuing a trigger voltage for exciting said strobe tube and a trigger signal in synchronism with said issuing of trigger voltage; a voltage detection circuit, connected across said DC power source, for detecting charged voltage of said main capacitor and issuing a charge completion signal to said charge control circuit when said charged voltage reaches a predetermined value; and a counter for counting said charge completion signals issued by said voltage detection circuit, said counter being reset by said trigger signal.

5. A strobe apparatus comprising:

a DC power source;

a first series connection of a strobe tube and a semiconductor switching device, said semiconductor switching device having a control electrode and being controlled by a controlling potential on the control electrode only, said first series connection being connected across said DC power source;

a second series connection of a main capacitor and a first diode of reverse direction with regards to charging of said main capacitor, said second series connection being connected across said DC power source; and a second diode of forward direction with regard to charging of said main capacitor, connected between a first junction point between said main capacitor and said first diode and second junction point between said strobe tube and said switching device;

said second diode completing a charging loop for said main capacitor by connecting from said DC power source through said main capacitor, said second diode and said semiconductor switching device; and said first diode completing a discharging loop for said main capacitor by connecting from said main capacitor through said strobe tube, said semiconductor switching device and said first diode.

6. A strobe apparatus according to claim 5 wherein said charging loop and said discharging loop are controlled by switching ON or OFF said semiconductor switching device.

7. A strobe apparatus comprising:

a strobe tube for emitting a flash of light;

a main capacitor for storing a charge employed to activate said strobe tube; and a semiconductor switching device for controlling both charging and discharging of said capacitor.

* * * * *